US008334745B2

(12) United States Patent
Chen et al.

(10) Patent No.: US 8,334,745 B2
(45) Date of Patent: Dec. 18, 2012

(54) TRANSFORMER HAVING LEAKAGE INDUCTANCE

(75) Inventors: Yi-Lin Chen, Taoyuan Hsien (TW); Bou-Jun Zung, Taoyuan Hsien (TW); Shih-Hsien Chang, Taoyuan Hsien (TW); Hsin-Wei Tsai, Taoyuan Hsien (TW); Zhi-Liang Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/750,925

(22) Filed: Mar. 31, 2010

(65) Prior Publication Data

US 2010/0253458 A1 Oct. 7, 2010

(30) Foreign Application Priority Data

Apr. 1, 2009 (TW) ..... 98110941 A

(51) Int. Cl.

| | |
|---|---|
| ***H01F 27/30*** | (2006.01) |
| ***H01F 27/28*** | (2006.01) |
| ***H01F 17/06*** | (2006.01) |
| ***H01F 27/29*** | (2006.01) |

(52) U.S. Cl. ..... 336/198; 336/170; 336/178; 336/192; 336/208

(58) Field of Classification Search ..... 336/131, 336/145, 170, 180, 192, 198, 208, 179, 182, 336/212

See application file for complete search history.

(56) References Cited

U.S. PATENT DOCUMENTS

| | | | | |
|---|---|---|---|---|
| 5,831,505 | A * | 11/1998 | Yamaguchi et al. | 336/83 |
| 7,221,252 | B1 * | 5/2007 | Chang et al. | 336/212 |
| 7,301,430 | B1 * | 11/2007 | Chan et al. | 336/200 |
| 7,528,694 | B2 * | 5/2009 | Tseng et al. | 336/212 |
| 7,646,278 | B2 * | 1/2010 | Yang et al. | 336/90 |
| 2006/0006974 | A1 * | 1/2006 | Yang et al. | 336/208 |
| 2007/0030109 | A1 * | 2/2007 | Kohno | 336/208 |
| 2007/0268103 | A1 * | 11/2007 | Fushimi | 336/145 |

* cited by examiner

*Primary Examiner* — Mohamad Musleh
*Assistant Examiner* — Mangtin Lian
(74) *Attorney, Agent, or Firm* — Kirton McConkie; Evan R. Witt

(57) ABSTRACT

A transformer includes a bobbin assembly, a primary winding coil, a first secondary winding coil, a second secondary winding coil, and a magnetic core assembly. The bobbin assembly includes a primary winding part, a first secondary winding part, a second secondary winding part and a channel. A first opening is formed in a bottom surface of the bobbin assembly and communicates with the channel. The primary winding coil is wound around the primary winding part. The first secondary winding coil is wound around the first secondary winding part. The second secondary winding coil is wound around the second secondary winding part. The magnetic core assembly is partially embedded into the channel of the bobbin assembly, and includes a first magnetic part and a second magnetic part. The second magnetic part includes a first extension post, and the first extension post is inserted into the first opening of the bobbin assembly.

19 Claims, 14 Drawing Sheets

6

TRANSFORMER HAVING LEAKAGE INDUCTANCE

FIELD OF THE INVENTION

The present invention relates to a transformer, and more particularly to a transformer having leakage inductance.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wounded around a winding section 121 of the bobbin 12. An isolating tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are overlapped with each other and wounded around the bobbin 12. As a consequence, there is less magnetic flux leakage generated from the primary winding coil 13 and the secondary winding coil 14. Under this circumstance, since the coupling coefficient is increased, the leakage inductance of the transformer is reduced and the power loss upon voltage regulation is reduced, the electric conversion efficiency of a power converter is enhanced.

In the new-generation electric products (e.g. LCD televisions), a backlight module is a crucial component for driving the light source because the LCD panel fails to illuminate by itself. Generally, the backlight module comprises a plurality of discharge lamps and a power supply system for driving these lamps. The discharge lamps are for example cold cathode fluorescent lamps (CCFLs). These discharge lamps are driven by an inverter circuit of the power supply system. As the size of the LCD panel is gradually increased, the length and the number of the lamps included in the LCD panel are increased and thus a higher driving voltage is required. As a consequence, the transformer of the inverter circuit is usually a high-voltage transformer with leakage inductance. For electrical safety, the primary winding coil and the secondary winding coil of such a transformer are separated by a partition element of the bobbin. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance.

Referring to FIG. 2, a schematic exploded view of a transformer used in the conventional LCD panels is illustrated. The transformer 2 of FIG. 2 principally comprises a magnetic core assembly 21, a first bobbin piece 22, a second bobbin piece 23, a primary winding coil 24 and a secondary winding coil 25. The first bobbin piece 22 has a first side plate 26. The second bobbin piece 23 has a second side plate 27 and a plurality of partition plates 23*a*. Several winding sections 23*b* are defined by any two adjacent partition plates 23*a*. In addition, a first base 26*a* and a second base 27*a* are extended from the first side plate 26 and the second side plate 27, respectively. Several pins 28 and 29 are respectively arranged on the bottom surfaces of the first base 26*a* and the second base 27*a*.

For winding the primary winding coil 24 on the first bobbin piece 22, a first terminal of the primary winding coil 24 is firstly soldered on a pin 28*a* under the first base 26*a*. The primary winding coil 24 is then successively wound around the first bobbin piece 22 in the direction distant from the first side plate 26. Afterward, a second terminal of the primary winding coil 24 is returned to be soldered onto another pin 28*b* under the first base 26*a*. For winding the secondary winding coil 25 on the second bobbin piece 23, a first terminal of the secondary winding coil 25 is firstly soldered on a pin 29*a* under the second base 27*a*. The secondary winding coil 25 is then successively wound around the winding sections 23*b* of the second bobbin piece 23 in the direction distant from the second side plate 27. Afterward, a second terminal of the secondary winding coil 25 is returned to be soldered onto another pin 29*b* under the second base 27*a*. Moreover, due to the partition plate 23*a* of the second bobbin piece 23, the primary winding coil 24 is separated from the secondary winding coil 25, thereby maintaining an electrical safety distance and increasing leakage inductance of the transformer 2.

The winding structure of the transformer 2, however, still has some drawbacks. For example, the primary winding coil 24 and the secondary winding coil 25 are subject to electromagnetic induction in the main magnetic circuit. Since the transformer 2 has no branch magnetic circuit, the coupling effect is good but the leakage inductance is insufficient and fails to be adjusted. In other words, the transformer 2 is not suitable to be used in the resonant circuit. Moreover, the electromagnetic induction of the transformer 2 readily generates electromagnetic interference. The electromagnetic interference adversely affects neighboring electronic components or circuitry of the circuit board.

Therefore, there is a need of providing a transformer having leakage inductance so as to obviate the drawbacks encountered from the prior art.

SUMMARY OF THE INVENTION

It is an object of the present invention to provide a transformer having adjustable leakage inductance and reduced electromagnetic interference.

In accordance with an aspect of the present invention, there is provided a transformer having leakage inductance. The transformer includes a bobbin assembly, a primary winding coil, a first secondary winding coil, a second secondary winding coil, and a magnetic core assembly. The bobbin assembly includes a primary winding part, a first secondary winding part, a second secondary winding part and a channel. A first opening is formed in a bottom surface of the bobbin assembly and communicates with the channel. The primary winding coil is wound around the primary winding part. The first secondary winding coil is wound around the first secondary winding part. The second secondary winding coil is wound around the second secondary winding part. The magnetic core assembly is partially embedded into the channel of the bobbin assembly, and includes a first magnetic part and a second magnetic part. The second magnetic part includes a first extension post, and the first extension post is inserted into the first opening of the bobbin assembly.

In accordance with another aspect of the present invention, there is provided a transformer having leakage inductance. The transformer includes a bobbin assembly, a first primary winding coil, a second primary winding coil, a first secondary winding coil, a second secondary winding coil, and a magnetic core assembly. The bobbin assembly includes a first primary winding part, a second primary winding part, a first secondary winding part, a second secondary winding part and a channel. A first opening is formed in a bottom surface of the bobbin assembly and communicates with the channel. The first primary winding coil is wound around the first primary winding part. The second primary winding coil is wound around the second primary winding part. The first secondary winding coil is wound around the first secondary winding part. The second secondary winding coil is wound around the second secondary winding part. The magnetic core assembly is partially embedded into the channel of the bobbin assembly, and includes a first magnetic part and a second magnetic part. The second magnetic part includes a first extension post, and the first extension post is inserted into the first opening of the bobbin assembly.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
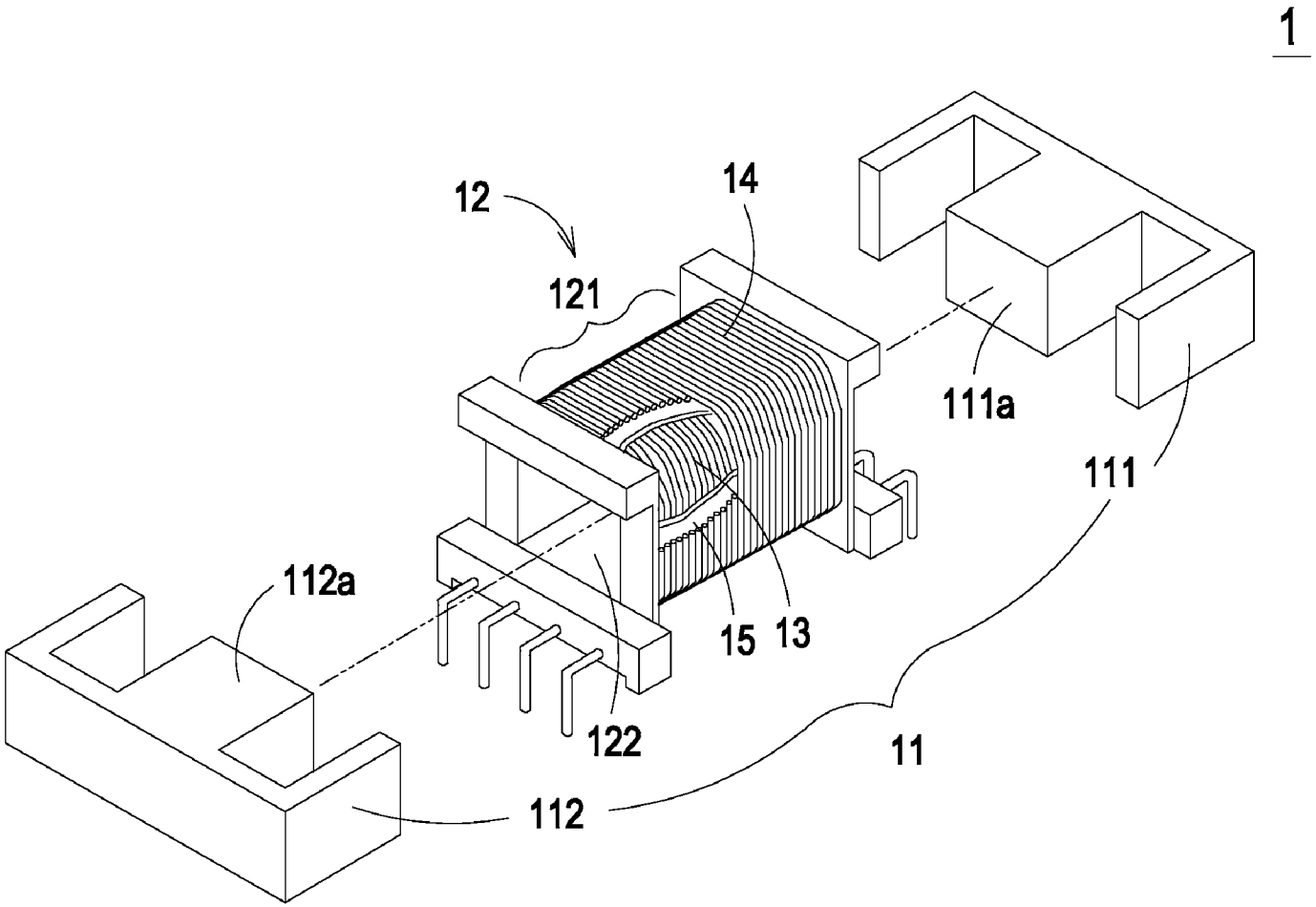
FIG. 1 PRIOR ART
FIG. 1 is a schematic exploded view of a conventional transformer.
Figure 2:
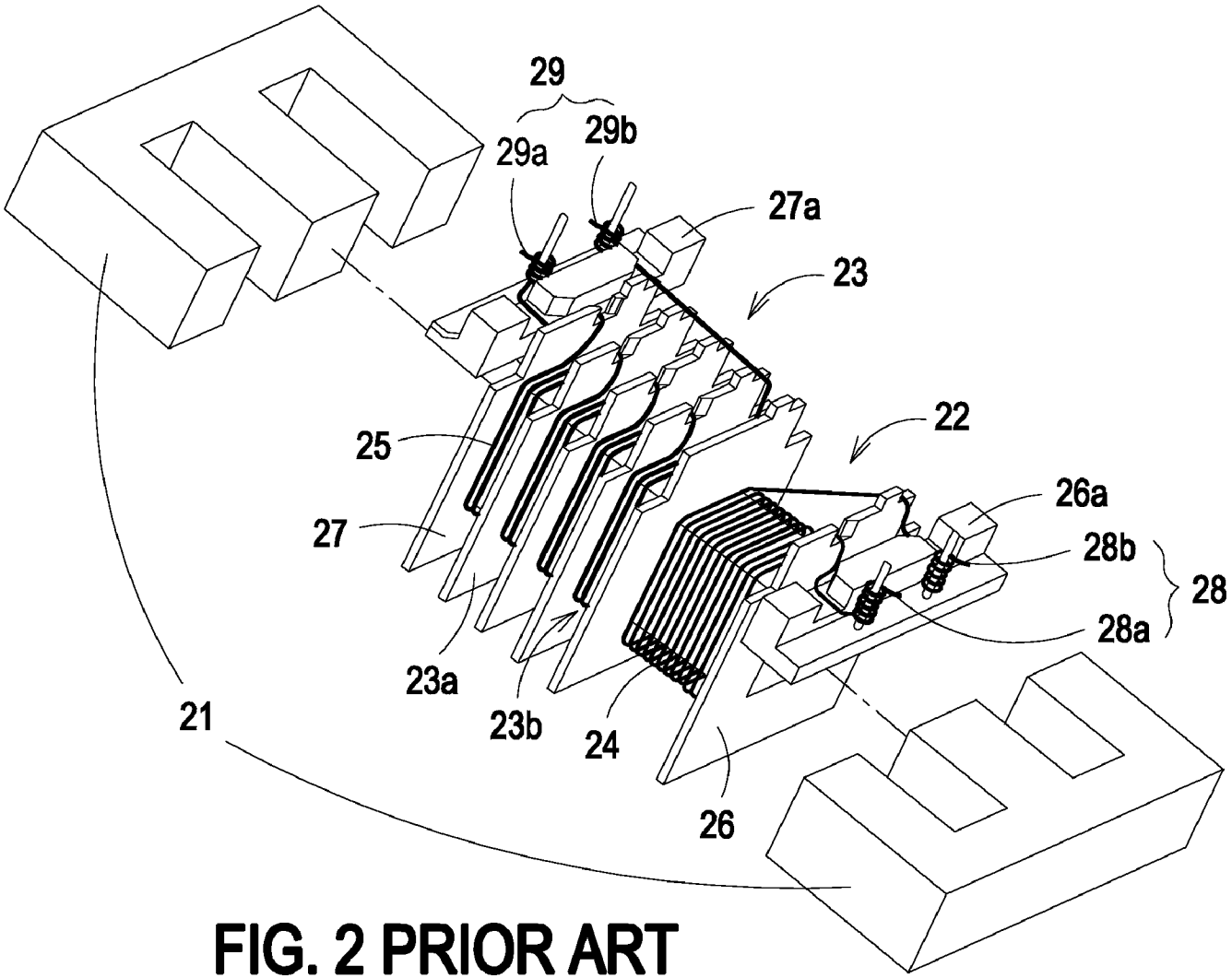
FIG. 2 PRIOR ART
FIG. 2 is a schematic exploded view illustrating a transformer used in the conventional LCD panels.
Figure 3A:
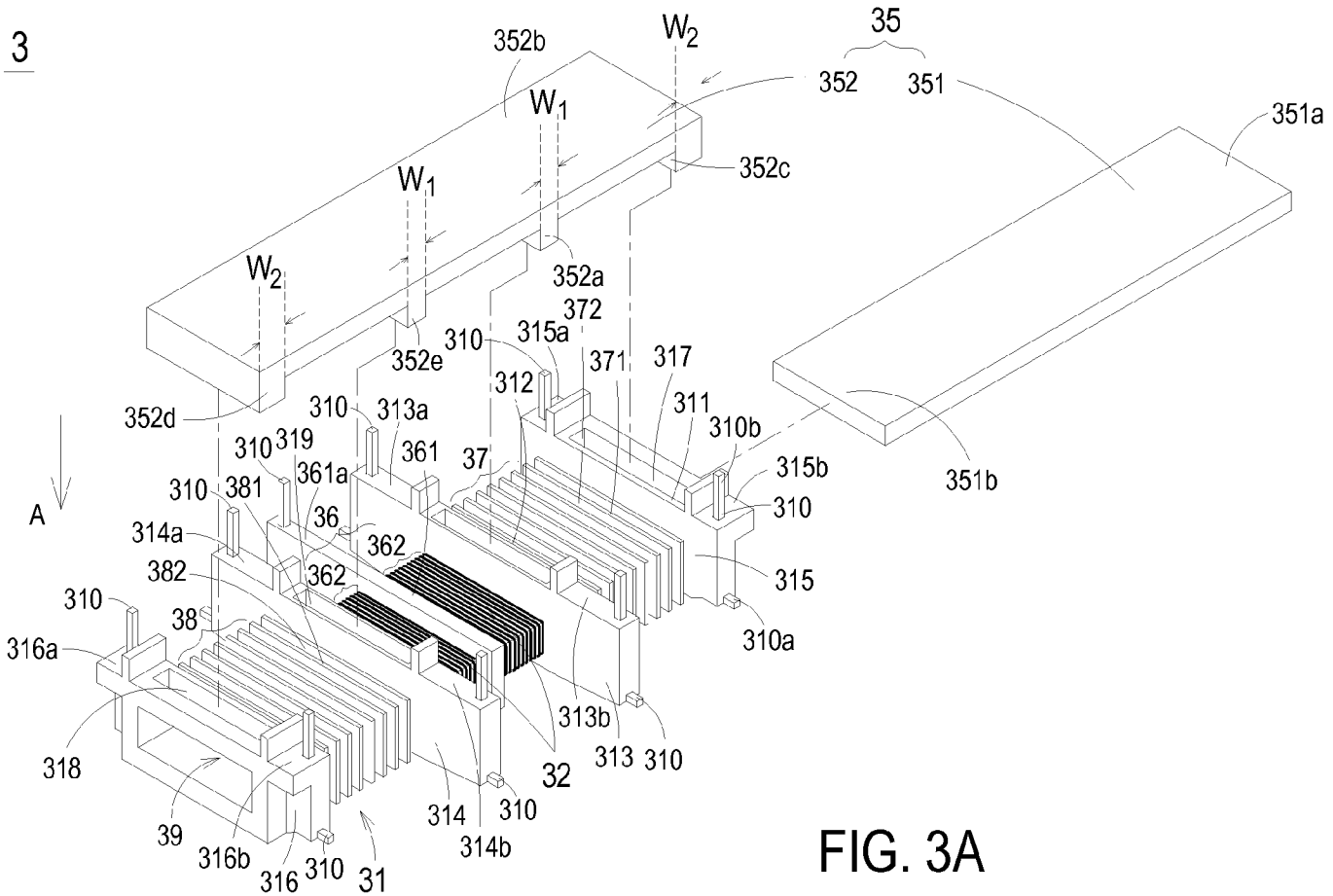
FIGS. 3A and 3B are schematic exploded views illustrating a transformer having leakage inductance according to an embodiment of the present invention and are taken from different viewpoints.
Figure 3B:
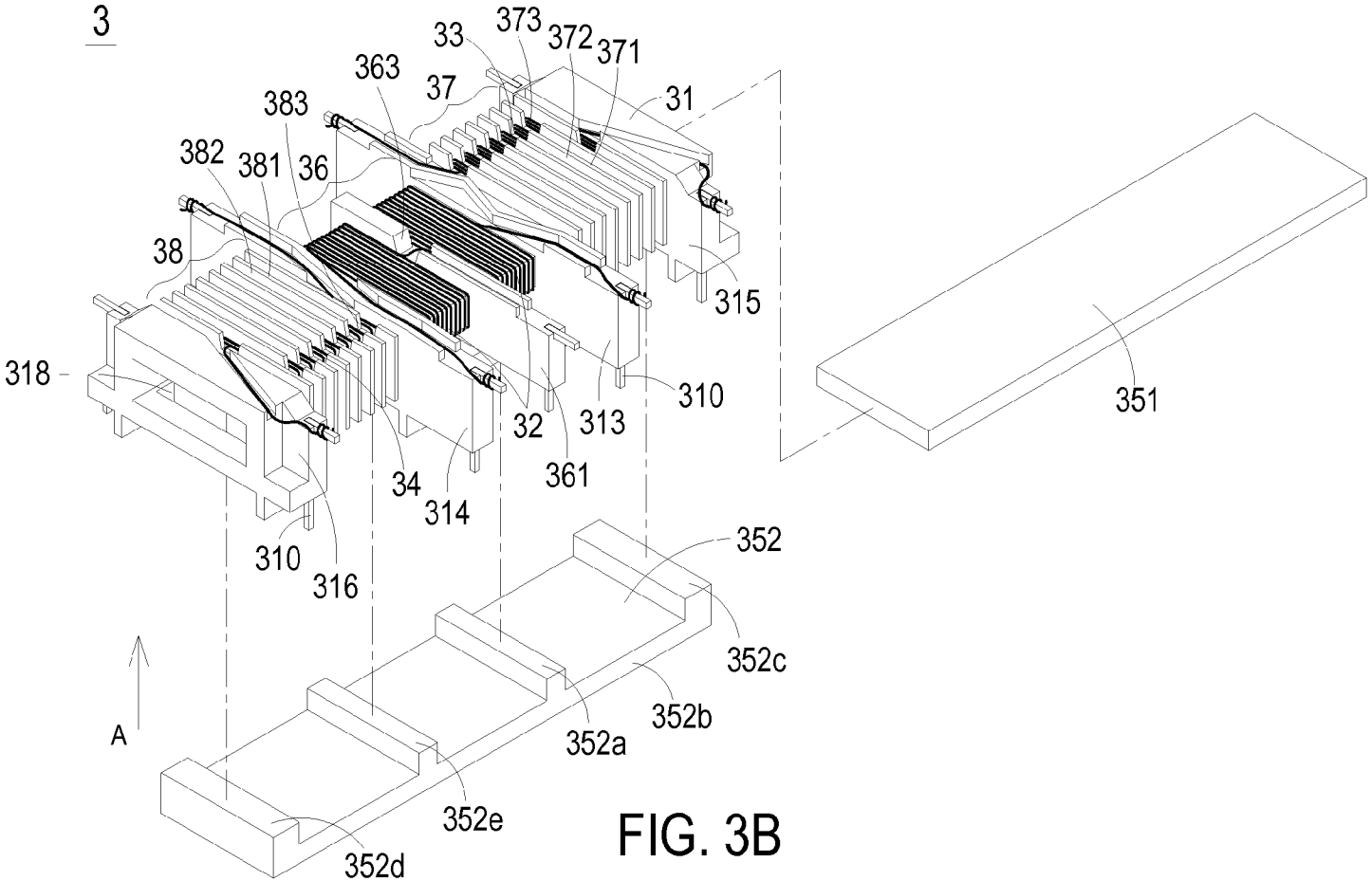

FIGS. 3A and 3B are schematic exploded views illustrating a transformer having leakage inductance according to an embodiment of the present invention and are taken from different viewpoints. As shown in FIGS. 3A and 3B, the transformer 3 comprises a bobbin assembly 31, a primary winding coil 32, a first secondary winding coil 33, a second secondary winding coil 34 and a magnetic core assembly 35. The bobbin assembly 31 comprises a primary winding part 36, a first secondary winding part 37, a second secondary winding part 38 and a channel 39. A first opening 312 is formed in the bottom surface 311 of the bobbin assembly 31. The first opening 312 communicates with the channel 39. The primary winding coil 32 is wound around the primary winding part 36 of the bobbin assembly 31. The first secondary winding coil 33 is wound around the first secondary winding part 37 of the bobbin assembly 31. The second secondary winding coil 34 is wound around the second secondary winding part 38 of the bobbin assembly 31. The magnetic core assembly 35 is partially embedded into the channel 39 of the bobbin assembly 31. The magnetic core assembly 35 includes a first magnetic part 351 and a second magnetic part 352. The second magnetic part 352 includes a first extension post 352*a*. The first extension post 352*a* is inserted into the first opening 312 of the bobbin assembly 31. As such, a main magnetic circuit is defined by the first magnetic part 351 and the second magnetic part 352, and a branch magnetic circuit is defined by the first extension post 352*a* of the second magnetic part 352. Due to the main magnetic circuit and the branch magnetic circuit, the leakage inductance of the transformer 3 is increased and adjustable.

In this embodiment, the primary winding part 36, the first secondary winding part 37 and the second secondary winding part 38 of the bobbin assembly 31 are made of insulating material and integrally formed into a one-piece structure. The primary winding part 36 is arranged at the middle section of the bobbin assembly 31. The primary winding part 36 includes one or more partition plates 361, wherein multiple winding sections 362 are defined by the one or more partition plates 361. Every partition plate 361 has one or more notches 363. The primary winding coil 32 is successively wound around the winding sections 362 through the one or more notches 363.

The first secondary winding part 37 and the second secondary winding part 38 are disposed at two opposite sides of the bobbin assembly 31. In other words, the first secondary winding part 37 and the second secondary winding part 38 are disposed on bilateral sides of the primary winding part 36. The first secondary winding part 37 is separated from the primary winding part 36 by a first separation plate 313. The second secondary winding part 38 is separated from the primary winding part 36 by a second separation plate 314. Due to the first separation plate 313 and the second separation plate 314, the electrical safety distance between the primary winding coil 32 and the first secondary winding coil 33 and the electrical safety distance between the primary winding coil 32 and the second secondary winding coil 34 are maintained. In addition, the first secondary winding part 37 and the second secondary winding part 38 have a first side plate 315 and a second side plate 316, respectively. The first secondary winding part 37 includes one or more partition plates 371, wherein multiple winding sections 372 are defined by the one or more partition plates 371. The second secondary winding part 38 includes one or more partition plates 381, wherein multiple winding sections 382 are defined by the one or more partition plates 381. According to voltage dividing principle, the numbers of the winding sections 372 and 382 may be varied depending on the voltage magnitude. Every partition plate 371 has one or more notches 373. The first secondary winding coil 33 is successively wound around the winding sections 372 through the one or more notches 373. Every partition plate 381 has one or more notches 383. The second secondary winding coil 34 is successively wound around the winding sections 382 through the one or more notches 383.

In this embodiment, the first opening 312 is extended from the bottom surface 311 of the bobbin assembly 31 to the inner portion of the first separation plate 313 and communicates with the channel 39. Moreover, a second opening 319 is extended from the bottom surface 311 of the bobbin assembly 31 to the inner portion of the second separation plate 314 and communicates with the channel 39. The bobbin assembly 31 further comprises a first slot 317 and a second slot 318. The first slot 317 is extended from the bottom surface 311 of the bobbin assembly 31 to the inner portion of the first side plate 315 and communicates with a first end of the channel 39. The second slot 318 is extended from the bottom surface 311 of the bobbin assembly 31 to the inner portion of the second side plate 316 and communicates with a second end of the channel 39.

In this embodiment, the first separation plate 313 includes one or more bobbin bases (313*a*, 313*b*), the second separation plate 314 includes one or more bobbin bases (314*a*, 314*b*), the first side plate 315 includes one or more bobbin bases (315*a*, 315*b*), the second side plate 316 includes one or more bobbin bases (316*a*, 316*b*), and the partition plate 361 includes one or more bobbin bases (361*a*). Several pins 310 (e.g. L-shaped pins) are protruded from the bobbin bases 313*a*, 313*b*, 314*a*, 314*b*, 315*a*, 315*b*, 316*a*, 316*b*, 361*a* of the bobbin assembly 31. The pins 310 are inserted into corresponding conductive holes of a circuit board (not shown). In this embodiment, each pin 310 includes a first connecting part 310*a* and a second connecting part 310*b*, which are perpendicular to each other. In other words, the first connecting part 310*a* and the second connecting part 310*b* are respectively protruded from two adjacent surfaces of a corresponding bobbin base. The primary winding coil 32, the first secondary winding coil 33 and the second secondary winding coil 34 are connected to corresponding first connecting parts 310*a* of the pins 310. The second connecting parts 310*b* of the pins 310 are inserted into corresponding conductive holes of a circuit board (not shown). The first connecting parts 310*a* and the second connecting parts 310*b* of the pins 310 are made of conductive material such as copper or aluminum. The first connecting parts 310*a* and the second connecting parts 310*b* are integrally formed such that the pins 310 are L-shaped.

In this embodiment, the first magnetic part 351 of the magnetic core assembly 35 is a slab-type core magnetic part. The first magnetic part 351 is accommodated with the channel 39. The second magnetic part 352 of the magnetic core assembly 35 includes a slab portion 352*b*, a first lateral post 352*c*, a second lateral post 352*d*, the first extension post 352*a* and a second extension post 352*e*. The first lateral post 352*c* and the second lateral post 352*d* are perpendicularly protruded from a first end and a second end of the slab portion 352*b*, respectively. The first extension post 352*a* and the second extension post 352*e* are also perpendicularly protruded from the slab portion 352*b*. The first extension post 352*a* and the second extension post 352*e* are arranged between the first lateral post 352*c* and the second lateral post 352*d*. In some embodiments, the first extension post 352*a* and the second extension post 352*e* have a first width $W_1$, respectively, and the first lateral post 352*c* and the second lateral post 352*d* have a second width $W_2$, respectively, wherein the second width $W_2$ is wider than the first width $W_1$, and the first extension post 352*a*, the second extension post 352*e*, the first lateral post 352*c*, and the second lateral post 352*d* have the same length, the cross-section area of each of the first lateral post 352*c* and the second lateral post 352*d* is greater than the cross-section area of each of the first extension post 352*a* and the second extension post 352*e*. The first lateral post 352*c* is inserted into the first slot 317 of the bobbin assembly 31 and contacted with a first end 351*a* of the first magnetic part 351. The second lateral post 352*d* is inserted into the second slot 318 of the bobbin assembly 31 and contacted with a second end 351*b* of the first magnetic part 351. The first extension post 352*a* is inserted into the first opening 312 of the bobbin assembly 31 and spaced from the first magnetic part 351 by a gap. The second extension post 352*e* is inserted into the second opening 319 of the bobbin assembly 31 and spaced from the first magnetic part 351 by a gap.

Figure 4:
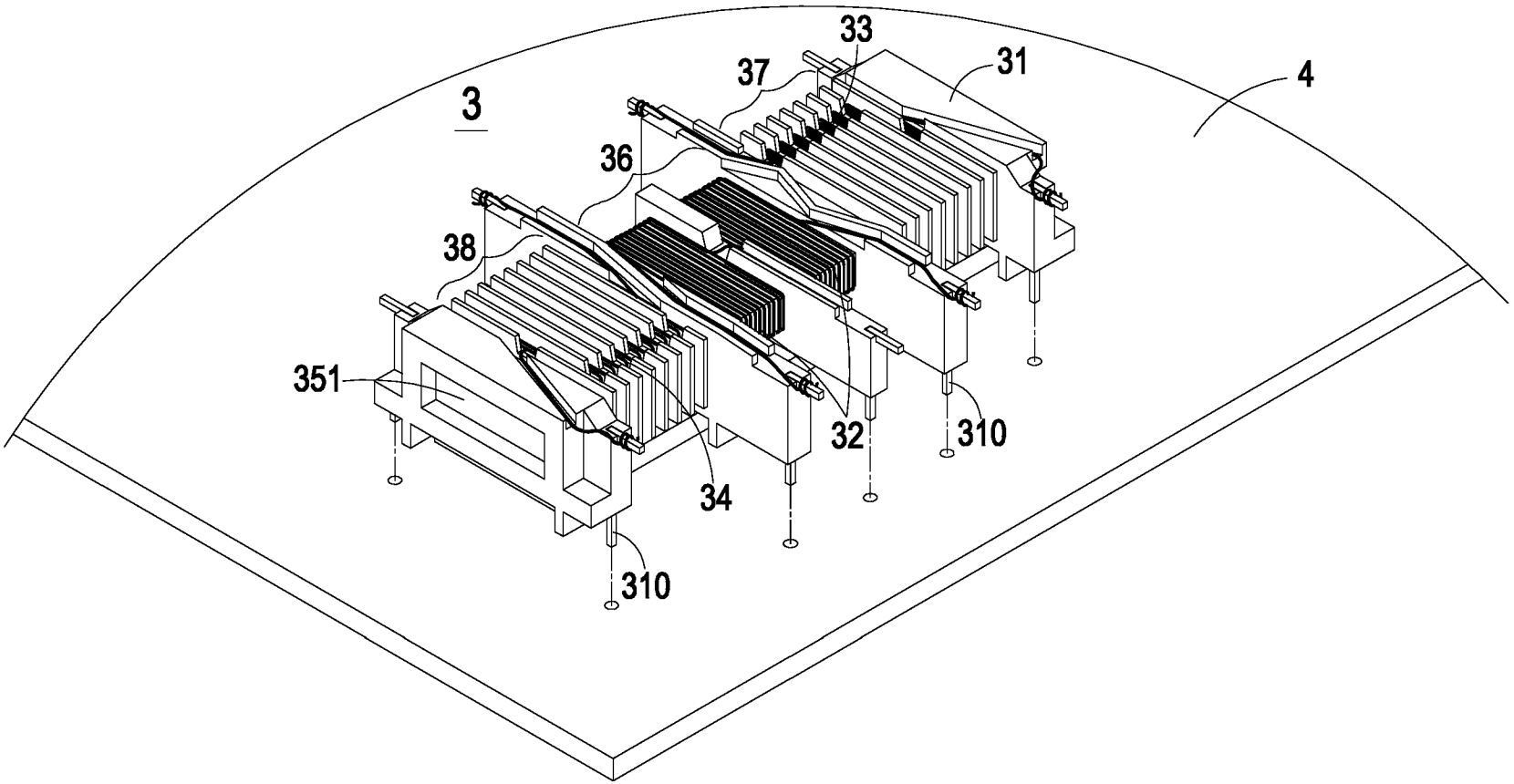
FIG. 4 is a schematic perspective view illustrating the transformer of FIG. 3 that is mounted on a circuit board.
Figure 5:
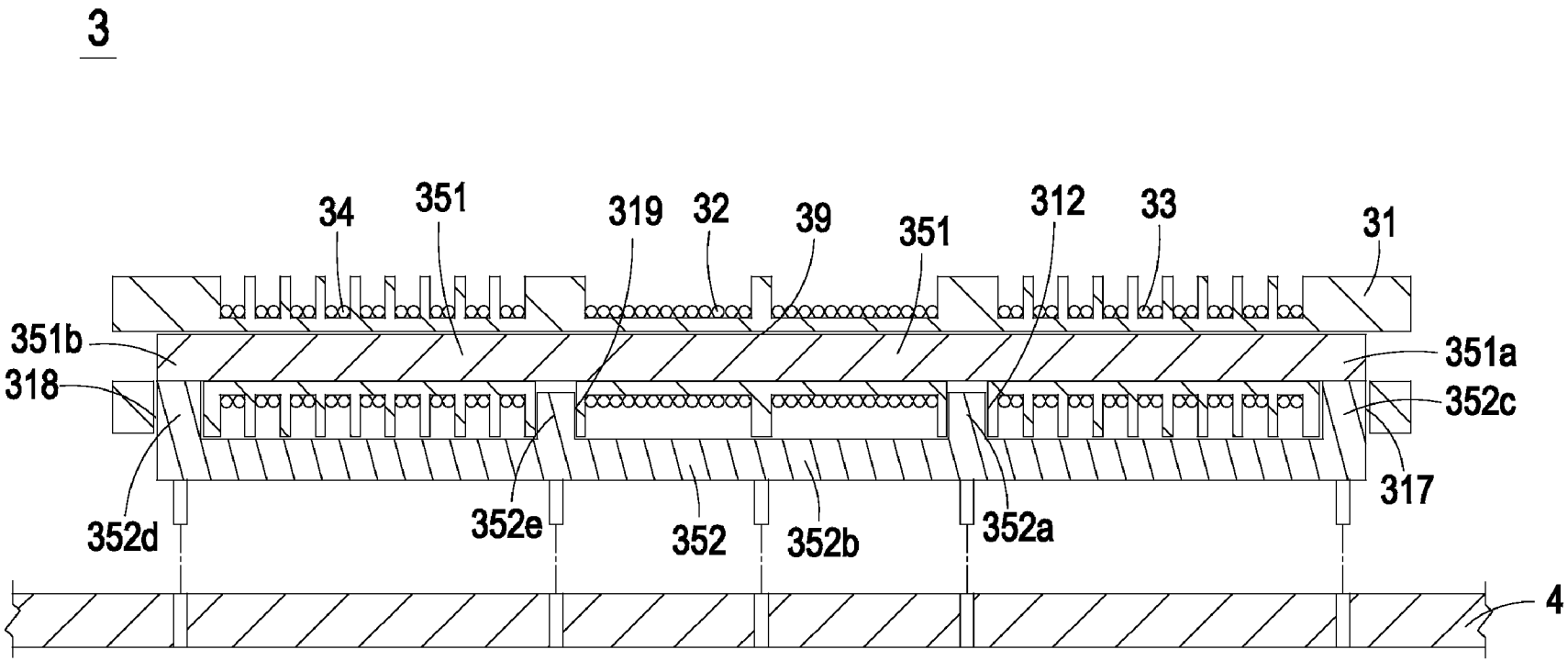
FIG. 5 is a schematic cross-sectional view illustrating the combination of the transformer and the circuit board of FIG. 4.

FIG. 4 is a schematic perspective view illustrating the transformer of FIG. 3 that is mounted on a circuit board. FIG. 5 is a schematic cross-sectional view illustrating the combination of the transformer and the circuit board of FIG. 4. Please refer to FIGS. 3A, 3B, 4 and 5. After the transformer 3 is assembled, the transformer 3 is mounted on a circuit board 4. The circuit board 4 includes a power supply system (not shown) for driving lamps. The primary winding coil 32, the first secondary winding coil 33 and the second secondary winding coil 34 are respectively wound around the primary winding part 36, the first secondary winding part 37 and the second secondary winding part 38 of the bobbin assembly 31. Both terminals of the primary winding coil 32 are soldered on respective pins 310. Both terminals of the first secondary winding coil 33 are soldered on respective pins 310. Both terminals of the second secondary winding coil 34 are soldered on respective pins 310. The first magnetic part 351 of the magnetic core assembly 35 is accommodated with the channel 39. The second magnetic part 352 of the magnetic core assembly 35 is disposed on the bottom surface 311 of the bobbin assembly 31, wherein the slab portion 352*b* of the second magnetic part 352 is arranged between the bottom surface 311 of the bobbin assembly 31 and the circuit board 4. The first lateral post 352*c* is inserted into the first slot 317 of the bobbin assembly 31 in a first direction A, which is extended from the bottom surface of the bobbin assembly 31 toward the channel 39, and contacted with the first end 351*a* of the first magnetic part 351. The second lateral post 352*d* is inserted into the second slot 318 of the bobbin assembly 31 in the first direction A and contacted with the second end 351*b* of the first magnetic part 351. The first extension post 352*a* is inserted into the first opening 312 of the bobbin assembly 31 in the first direction A and spaced from the first magnetic part 351 by a gap. The second extension post 352*e* is inserted into the second opening 319 of the bobbin assembly 31 in the first direction A and spaced from the first magnetic part 351 by a gap.

When a voltage is applied to the primary winding coil 32, a current is inputted into the primary winding coil 32 such that electromagnetic induction is rendered on the primary winding coil 32. Meanwhile, an induction voltage and an induction current are respectively generated in the first secondary winding coil 33 and second secondary winding coil 34. As such, a main magnetic circuit generated by the primary winding coil 32, the first secondary winding coil 33 and second secondary winding coil 34 run through the first magnetic part 351 and the second magnetic part 352. That is, the magnetic line of force successively passes through the first lateral post 352*c*, the slab portion 352*b*, the second lateral post 352*d* and the first magnetic part 351 and then returns back to the second magnetic part 352. The first extension post 352*a* is arranged between the primary winding coil 32 and the first secondary winding coil 33. The second extension post 352*e* is arranged between the primary winding coil 32 and the second secondary winding coil 34. Since the first extension post 352*a* and the second extension post 352*e* are respectively inserted into the first opening 312 and the second opening 319 and separated from the first magnetic part 351 by a gap, a branch magnetic circuit is defined by the first extension post 352*a* and the second extension post 352*e*. Due to the main magnetic circuit and the branch magnetic circuit, the leakage inductance of the transformer 3 is increased and adjustable. As a consequence, the transformer of the present invention can be applied to any resonant circuit. Since the second magnetic part 352 is disposed on the bottom surface 311 of the bobbin assembly 31 and arranged between the bobbin assembly 31 and the circuit board 4, the electromagnetic interference generated by the transformer 3 has reduced influence on neighboring electronic components or circuitry of the circuit board 4.

Figure 6A:
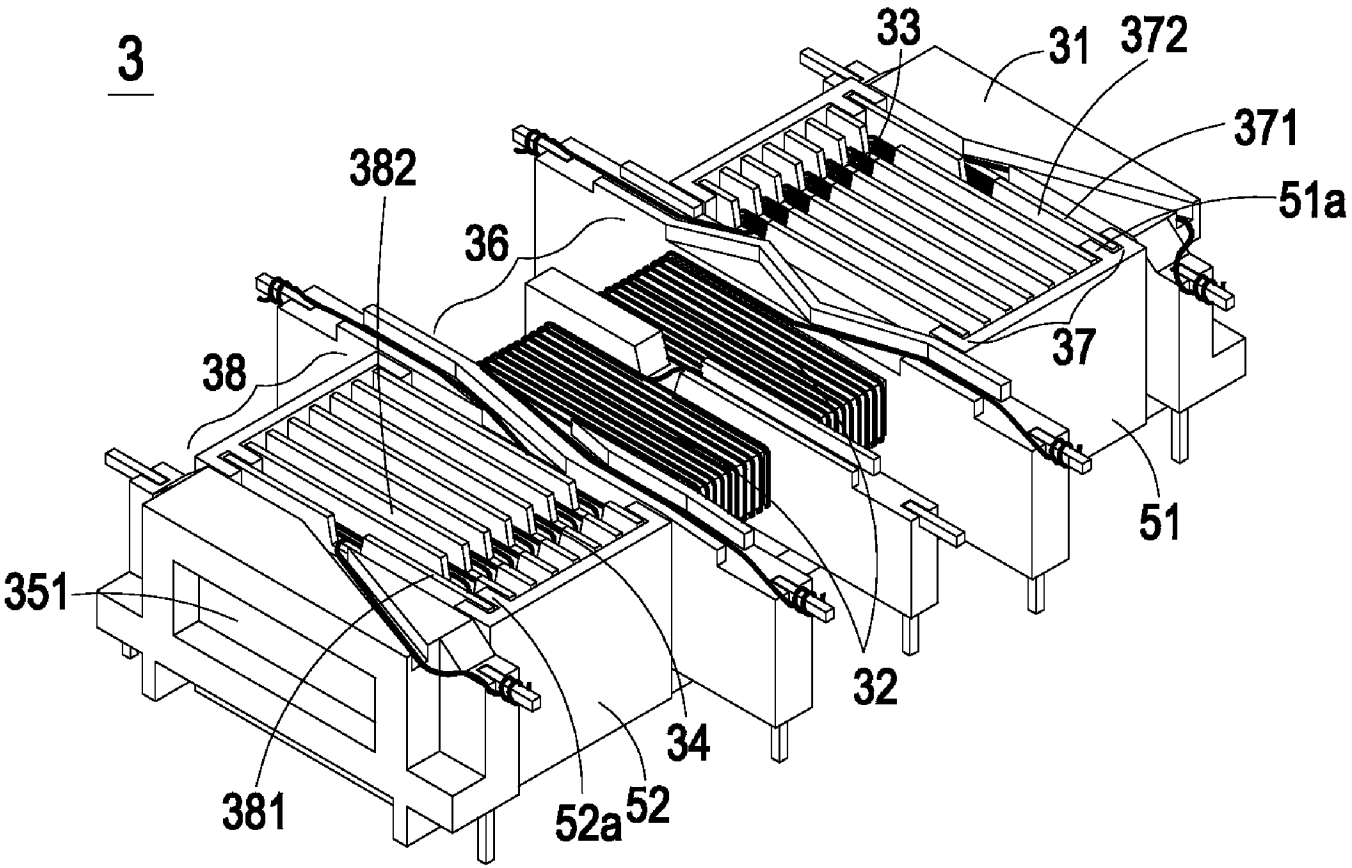
FIGS. 6A and 6B are respectively schematic assembled and cross-sectional views illustrating a combination of the transformer of FIG. 3 and two insulating covers.
Figure 6B:
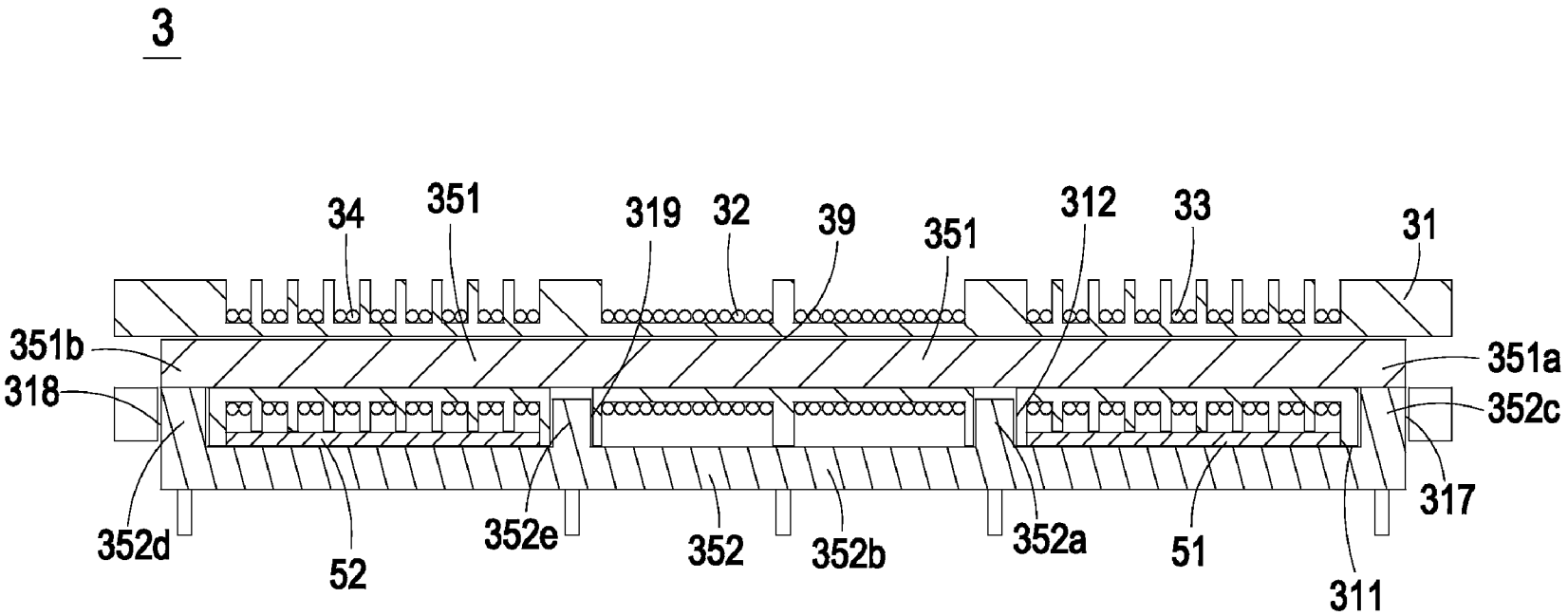

For protecting the first secondary winding part 37 and the second secondary winding part 38, the transformer 3 further comprises one or more insulating covers. FIGS. 6A and 6B are respectively schematic assembled and cross-sectional views illustrating a combination of the transformer of FIG. 3 and two insulating covers. As shown in FIGS. 6A and 6B, the transformer 3 includes two insulating covers 51 and 52 for partially sheltering the first secondary winding part 37 and/or the second secondary winding part 38. After the primary winding coil 32, the first secondary winding coil 33 and the second secondary winding coil 34 are wound around the bobbin assembly 31, the first insulating cover 51 is sheathed around the first secondary winding part 37. In some embodiments, at least one rib 51*a* is formed on the inner surface of the first insulating cover 51. When the rib 51*a* is engaged with a corresponding winding section 372, the first insulating cover 51 is combined with the bobbin assembly 31 so as to partially shield the first secondary winding part 37 and the first secondary winding coil 33. Moreover, after the primary winding coil 32, the first secondary winding coil 33 and the second secondary winding coil 34 are wound around the bobbin assembly 31, the second insulating cover 52 is sheathed around the second secondary winding part 38. In some embodiments, at least one rib 52*a* is formed on the inner surface of the second insulating cover 52. When the rib 52*a* is engaged with a corresponding winding section 382, the second insulating cover 52 is combined with the bobbin assembly 31 so as to partially shield the second secondary winding part 38 and the second secondary winding coil 34.

After the bobbin assembly 31 is sheathed by the first insulating cover 51 and the second insulating cover 52, the first magnetic part 351 of the magnetic core assembly 35 is accommodated within the channel 39 and the second magnetic part 352 is disposed on the bottom surface 311 of the bobbin assembly 31. The slab portion 352*b* of the second magnetic part 352 is arranged between the bottom surface 311 of the bobbin assembly 31 and the circuit board 4. The first lateral post 352*c* is inserted into the first slot 317 of the bobbin assembly 31 and contacted with the first end 351*a* of the first magnetic part 351. The second lateral post 352*d* is inserted into the second slot 318 of the bobbin assembly 31 and contacted with the second end 351*b* of the first magnetic part 351. The first extension post 352*a* is inserted into the first opening 312 of the bobbin assembly 31 and spaced from the first magnetic part 351 by a gap. The second extension post 352*e* is inserted into the second opening 319 of the bobbin assembly 31 and spaced from the first magnetic part 351 by a gap. The first insulating cover 51 is arranged between the first secondary winding coil 33 and the second magnetic part 352 so as to maintain an electrical safety distance between the first secondary winding coil 33 and the second magnetic part 352. Similarly, the second insulating cover 52 is arranged between the second secondary winding coil 34 and the second magnetic part 352 so as to maintain an electrical safety distance between the second secondary winding coil 34 and the second magnetic part 352.

Figure 7A:
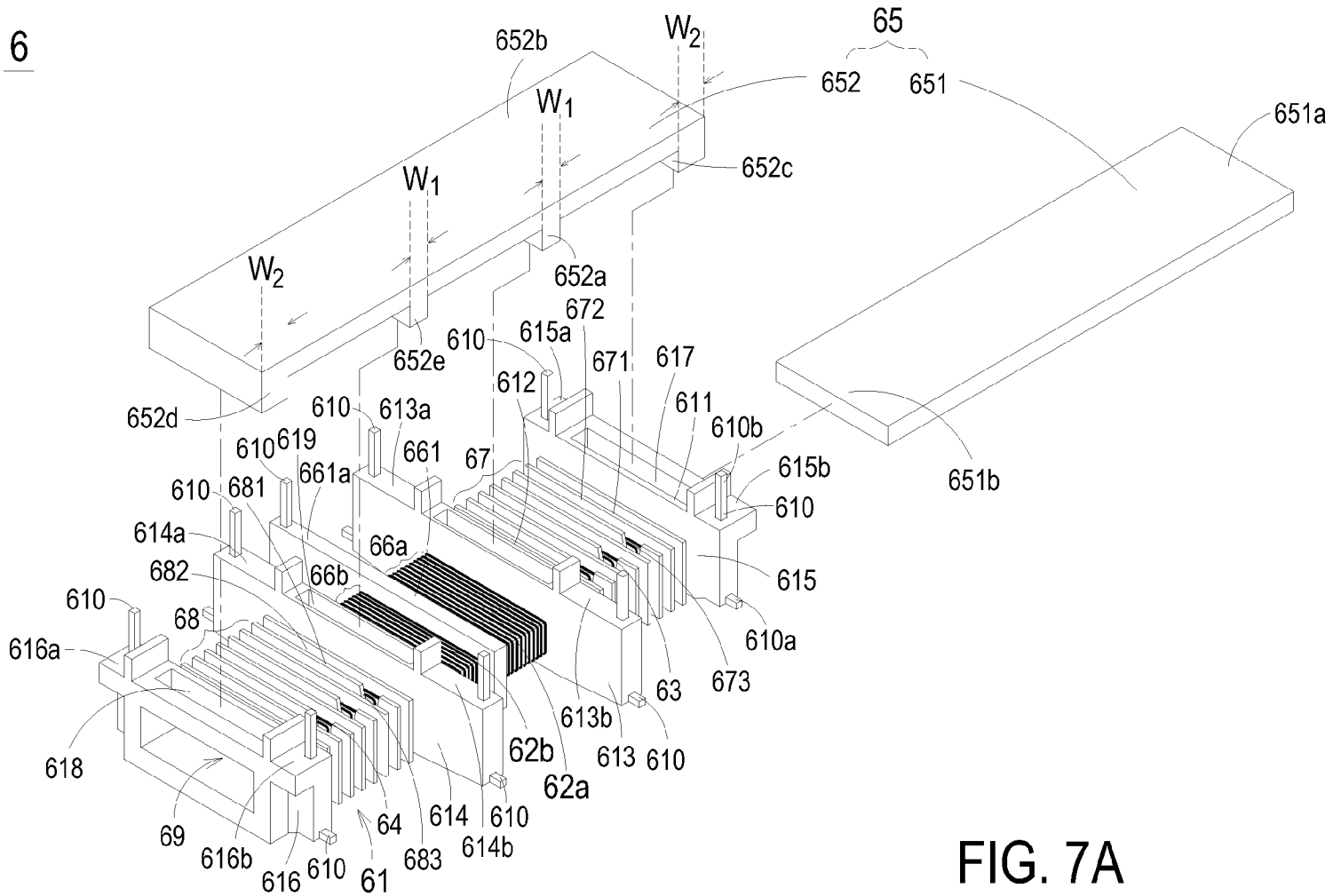
FIGS. 7A and 7B are schematic exploded views illustrating a transformer having leakage inductance according to another embodiment of the present invention and are taken from different viewpoints.
Figure 7B:
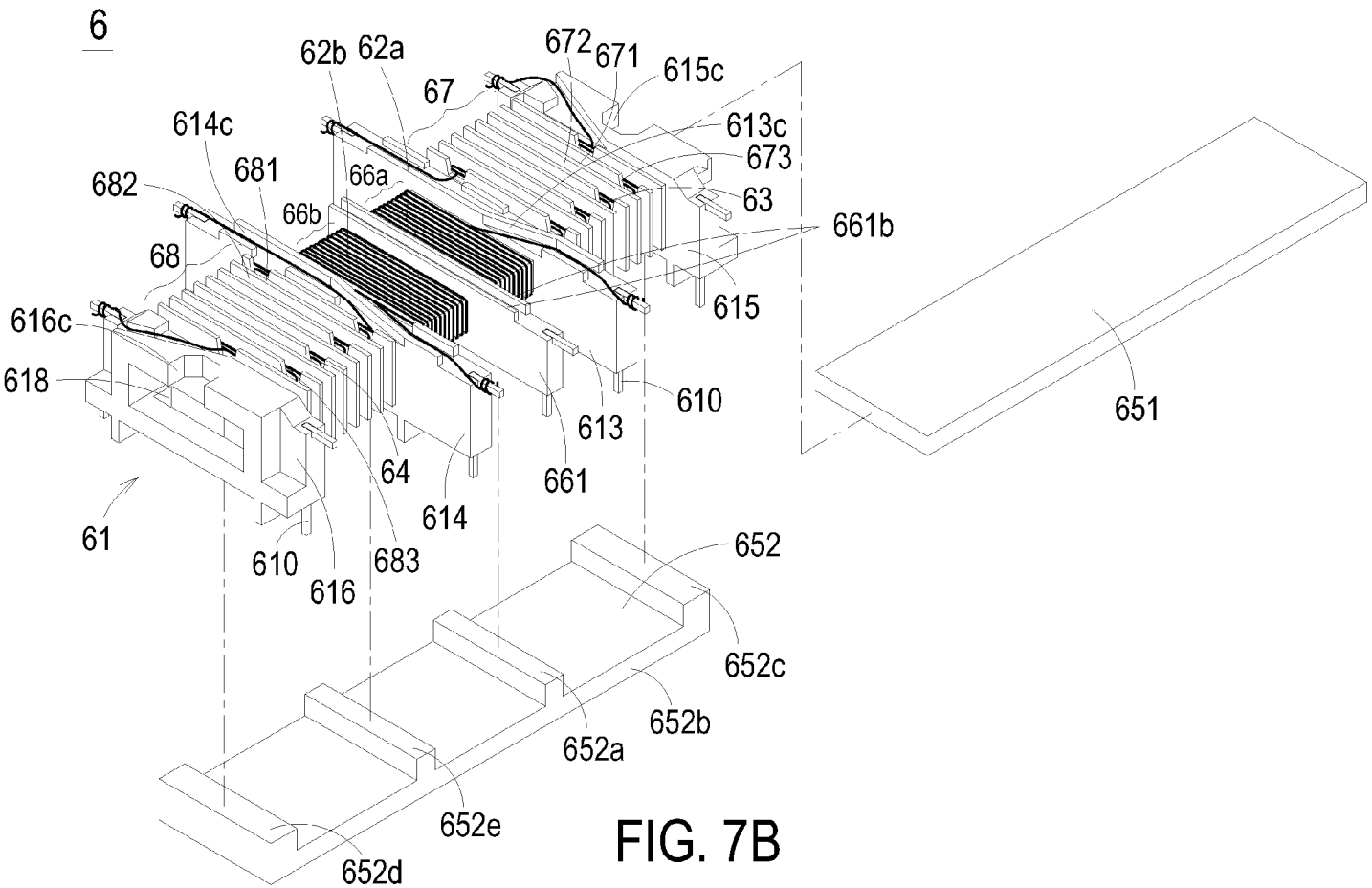

FIGS. 7A and 7B are schematic exploded views illustrating a transformer having leakage inductance according to another embodiment of the present invention and are taken from different viewpoints. As shown in FIGS. 7A and 7B, the transformer 6 comprises a bobbin assembly 61, a first primary winding coil 62*a*, a second primary winding coil 62*b*, a first secondary winding coil 63, a second secondary winding coil 64 and a magnetic core assembly 65. The bobbin assembly 61 comprises a first primary winding part 66*a*, a second primary winding part 66*b*, a first secondary winding part 67, a second secondary winding part 68 and a channel 69. A first opening 612 is formed in the bottom surface 611 of the bobbin assembly 61. The first opening 612 communicates with the channel 69. The first primary winding coil 62*a* is wound around the first primary winding part 66*a* of the bobbin assembly 61. The second primary winding coil 62*b* is wound around the second primary winding part 66*b* of the bobbin assembly 61. The first secondary winding coil 63 is wound around the first secondary winding part 67 of the bobbin assembly 61. The second secondary winding coil 64 is wound around the second secondary winding part 68 of the bobbin assembly 61. The magnetic core assembly 65 is partially embedded into the channel 69 of the bobbin assembly 61. The magnetic core assembly 65 includes a first magnetic part 651 and a second magnetic part 652. The second magnetic part 652 includes a first extension post 652*a*. The first extension post 652*a* is inserted into the first opening 612 of the bobbin assembly 61. As such, a main magnetic circuit is defined by the first magnetic part 651 and the second magnetic part 652, and a branch magnetic circuit is defined by the first extension post 652*a* of the second magnetic part 652. Due to the main magnetic circuit and the branch magnetic circuit, the leakage inductance of the transformer 6 is increased and adjustable.

In this embodiment, the first primary winding part 66*a*, the second primary winding part 66*b*, the first secondary winding part 67 and the second secondary winding part 68 of the bobbin assembly 61 are made of insulating material and integrally formed into a one-piece structure. The first primary winding part 66*a* and the second primary winding part 66*b* are arranged at the middle section of the bobbin assembly 61. The first primary winding part 66*a* and the second primary winding part 66*b* are separated from each other by a partition plate 661.

The first secondary winding part 67 and the second secondary winding part 68 are disposed at two opposite sides of the bobbin assembly 61. In other words, the first secondary winding part 67 and the second secondary winding part 68 are disposed on bilateral sides of the first primary winding part 66*a* and the second primary winding part 66*b*. The first secondary winding part 67 is separated from the first primary winding part 66*a* by a first separation plate 613. The second secondary winding part 68 is separated from the second primary winding part 66*b* by a second separation plate 614. Due to the first separation plate 613 and the second separation plate 614, the electrical safety distance between the first primary winding coil 62*a* and the first secondary winding coil 63 and the electrical safety distance between the second primary winding coil 62*b* and the second secondary winding coil 64 are maintained. In addition, the first secondary winding part 67 and the second secondary winding part 68 have a first side plate 615 and a second side plate 616, respectively. The first secondary winding part 67 includes one or more partition plates 671, wherein multiple winding sections 672 are defined by the one or more partition plates 671. The second secondary winding part 68 includes one or more partition plates 681, wherein multiple winding sections 682 are defined by the one or more partition plates 681. According to voltage dividing principle, the numbers of the winding sections 672 and 682 may be varied depending on the voltage magnitude. Every partition plate 671 has one or more notches 673. The first secondary winding coil 63 is successively wound around the winding sections 672 through the one or more notches 673. Every partition plate 681 has one or more notches 683. The second secondary winding coil 64 is successively wound around the winding sections 382 through the one or more notches 683. In some embodiments, a rib 613*c* is formed on the first separation plate 613 for increasing the creepage distance between the first primary winding coil 62*a* and the first secondary winding coil 63. Similarly, a rib 614*c* is formed on the second separation plate 614 for increasing the creepage distance between the second primary winding coil 62*b* and the second secondary winding coil 64. Similarly, a rib 661*b* is formed on the partition plate 661 for increasing the creepage distance between the first primary winding coil 62*a* and the second primary winding coil 62*b*.

In this embodiment, the first opening 612 is extended from the bottom surface 611 of the bobbin assembly 61 to the inner portion of the first separation plate 613 and communicates with the channel 69. Moreover, a second opening 619 is extended from the bottom surface 611 of the bobbin assembly 61 to the inner portion of the second separation plate 614 and communicates with the channel 69. The bobbin assembly 61 further comprises a first slot 617 and a second slot 618. The first slot 617 is extended from the bottom surface 611 of the bobbin assembly 61 to the inner portion of the first side plate 615 and communicates with a first end of the channel 69. The second slot 618 is extended from the bottom surface 611 of the bobbin assembly 61 to the inner portion of the second side plate 616 and communicates with a second end of the channel 69.

In this embodiment, the first separation plate 613 includes one or more bobbin bases (613*a*, 613*b*), the second separation plate 614 includes one or more bobbin bases (614*a*, 614*b*), the first side plate 615 includes one or more bobbin bases (615*a*, 615*b*), the second side plate 616 includes one or more bobbin bases (616*a*, 616*b*), and the partition plate 661 includes one or more bobbin bases (661*a*). Several pins 610 (e.g. L-shaped pins) are protruded from the bobbin bases 613*a*, 613*b*, 614*a*, 614*b*, 615*a*, 615*b*, 616*a*, 616*b*, 661*a* of the bobbin assembly 61. The pins 610 are inserted into corresponding conductive holes of a circuit board (not shown). In this embodiment, each pin 610 includes a first connecting part 610*a* and a second connecting part 610*b*, which are perpendicular to each other. In other words, the first connecting part 610*a* and the second connecting part 610*b* are respectively protruded from two adjacent surfaces of a corresponding bobbin base. The first primary winding coil 62*a*, the second primary winding coil 62*b*, the first secondary winding coil 63 and the second secondary winding coil 64 are connected to corresponding first connecting parts 610*a* of the pins 610. The second connecting parts 610*b* of the pins 610 are inserted into corresponding conductive holes of a circuit board (not shown). The first connecting parts 610*a* and the second connecting parts 610*b* of the pins 610 are made of conductive material such as copper or aluminum. The first connecting parts 610*a* and the second connecting parts 610*b* are integrally formed such that the pins 610 are L-shaped.

In this embodiment, the first magnetic part 651 of the magnetic core assembly 65 is a slab-type core magnetic part. The first magnetic part 651 is accommodated with the channel 69. The second magnetic part 652 of the magnetic core assembly 65 includes a slab portion 652*b*, a first lateral post 652*c*, a second lateral post 652*d*, the first extension post 652*a* and a second extension post 652*e*. The first lateral post 652*c* and the second lateral post 652*d* are perpendicularly protruded from a first end and a second end of the slab portion 652*b*, respectively. The first extension post 652*a* and the second extension post 652*e* are also perpendicularly protruded from the slab portion 652*b*. The first extension post 652*a* and the second extension post 652*e* are arranged between the first lateral post 652*c* and the second lateral post 652*d*. In some embodiments, the first extension post 652*a* and the second extension post 652*e* have a first width $W_1$, respectively, and the first lateral post 652*c* and the second lateral post 652*d* have a second width $W_2$, respectively, wherein the second width $W_2$ is wider than the first width $W_1$, and the first extension post 652*a*, the second extension post 652*e*, the first lateral post 652*c*, and the second lateral post 652*d* have the same length, the cross-section area of each of the first lateral post 652*c* and the second lateral post 652*d* is greater than the cross-section area of each of the first extension post 652*a* and the second extension post 652*e*. The first lateral post 652*c* is inserted into the first slot 617 of the bobbin assembly 61 and contacted with a first end 651*a* of the first magnetic part 651. The second lateral post 652*d* is inserted into the second slot 618 of the bobbin assembly 631 and contacted with a second end 651*b* of the first magnetic part 651. The first extension post 652*a* is inserted into the first opening 612 of the bobbin assembly 61 and spaced from the first magnetic part 651 by a gap. The second extension post 652*e* is inserted into the second opening 619 of the bobbin assembly 361 and spaced from the first magnetic part 651 by a gap.

In some embodiments, a first concave part 615*c* and a second concave part 616*c* are respectively formed on the first side plate 615 and the second side plate 616. After the first magnetic part 651 and the second magnetic part 652 of the magnetic core assembly 65 are combined with the bobbin assembly 61, the first concave part 615*c* and the second concave part 616*c* are clamped by a clamping element (not shown) so as to fix the magnetic core assembly 65 on the bobbin assembly 61. Alternatively, the magnetic core assembly 65 is fixed on the bobbin assembly 61 by adhesive or an insulating tape.

Figure 8:
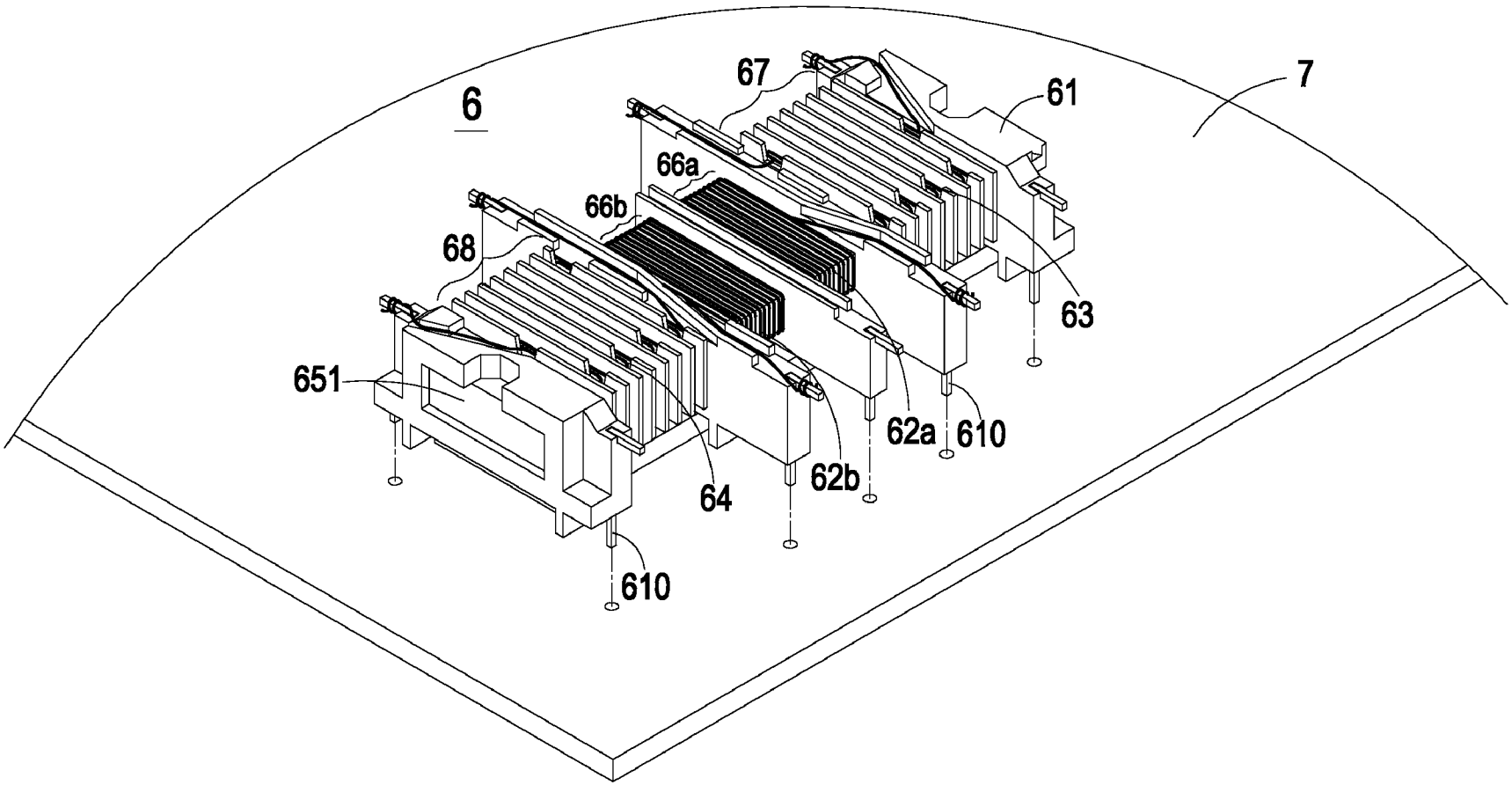
FIG. 8 is a schematic perspective view illustrating the transformer of FIG. 7 that is mounted on a circuit board.
Figure 9:
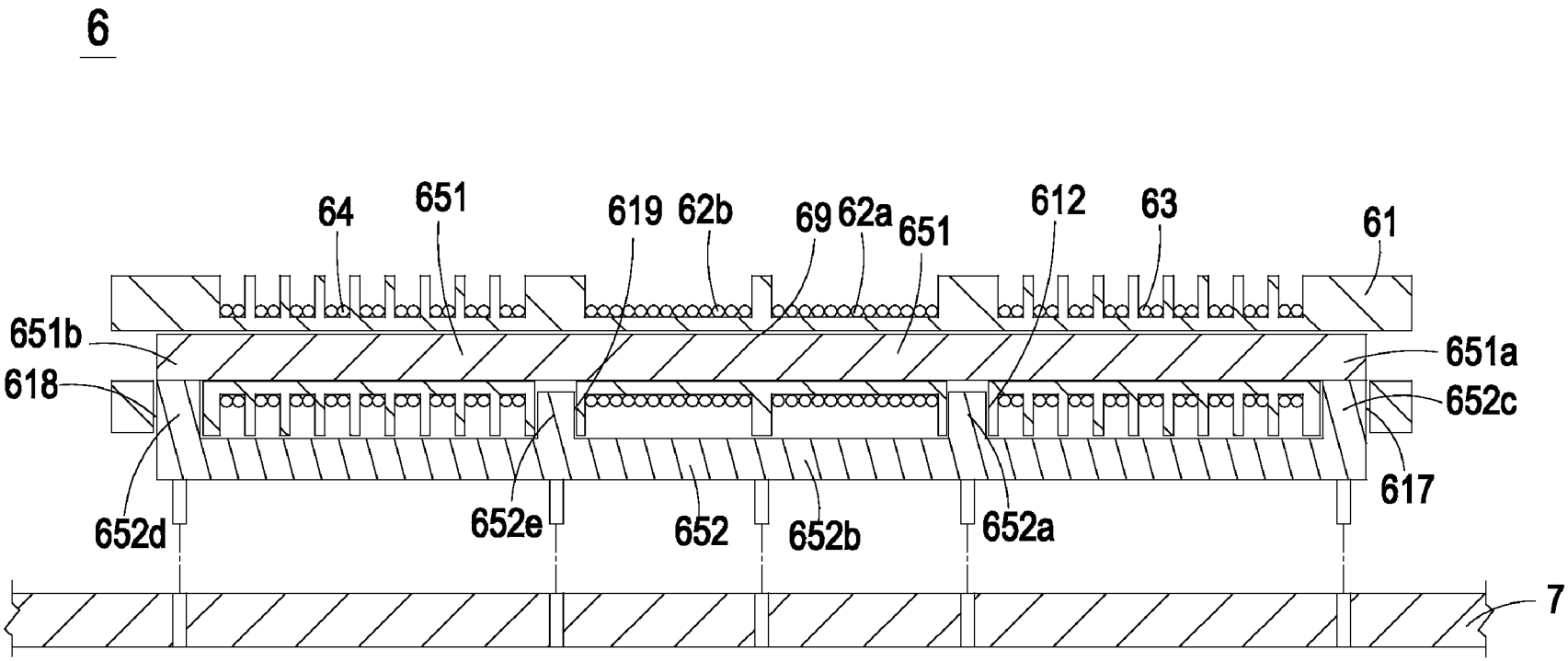
FIG. 9 is a schematic cross-sectional view illustrating the combination of the transformer and the circuit board of FIG. 8.

FIG. 8 is a schematic perspective view illustrating the transformer of FIG. 7 that is mounted on a circuit board. FIG. 9 is a schematic cross-sectional view illustrating the combination of the transformer and the circuit board of FIG. 8. Please refer to FIGS. 7A, 7B, 8 and 9. After the transformer 6 is assembled, the transformer 6 is mounted on a circuit board 7. The circuit board 7 includes a power supply system (not shown) for driving lamps. The first primary winding coil 62*a*, the second primary winding coil 62*b*, the first secondary winding coil 63 and the second secondary winding coil 64 are respectively wound around the first primary winding part 66*a*, the second primary winding part 66*b*, the first secondary winding part 67 and the second secondary winding part 68 of the bobbin assembly 61. Both terminals of the first primary winding coil 62*a* are soldered on respective pins 610. Both terminals of the second primary winding coil 62*b* are soldered on respective pins 610. Both terminals of the first secondary winding coil 63 are soldered on respective pins 610. Both terminals of the second secondary winding coil 64 are soldered on respective pins 610. The first magnetic part 651 of the magnetic core assembly 65 is accommodated with the channel 69. The second magnetic part 652 of the magnetic core assembly 65 is disposed on the bottom surface 611 of the bobbin assembly 61, wherein the slab portion 652*b* of the second magnetic part 652 is arranged between the bottom surface 611 of the bobbin assembly 61 and the circuit board 7. The first lateral post 652*c* is inserted into the first slot 617 of the bobbin assembly 61 and contacted with the first end 651*a* of the first magnetic part 651. The second lateral post 652*d* is inserted into the second slot 618 of the bobbin assembly 61 and contacted with the second end 651*b* of the first magnetic part 651. The first extension post 652*a* is inserted into the first opening 612 of the bobbin assembly 61 and spaced from the first magnetic part 651 by a gap. The second extension post 652*e* is inserted into the second opening 619 of the bobbin assembly 61 and spaced from the first magnetic part 651 by a gap. The operating principles of the transformer 6 are similar to those of the transformer 3 shown in FIG. 3, and are not redundantly described herein.

Figure 10A:
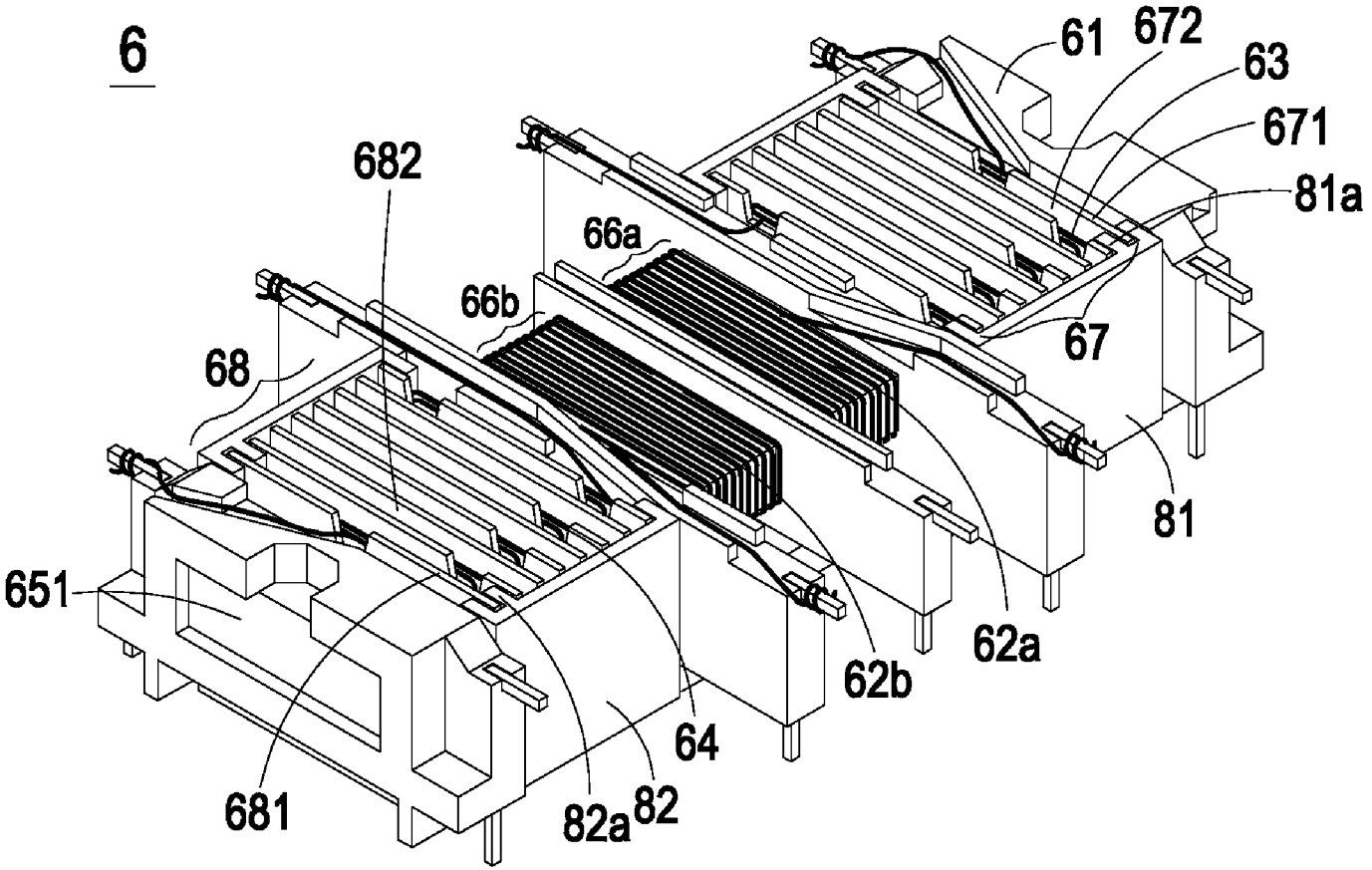
FIGS. 10A and 10B are respectively schematic assembled and cross-sectional views illustrating a combination of the transformer of FIG. 7 and two insulating covers.
Figure 10B:
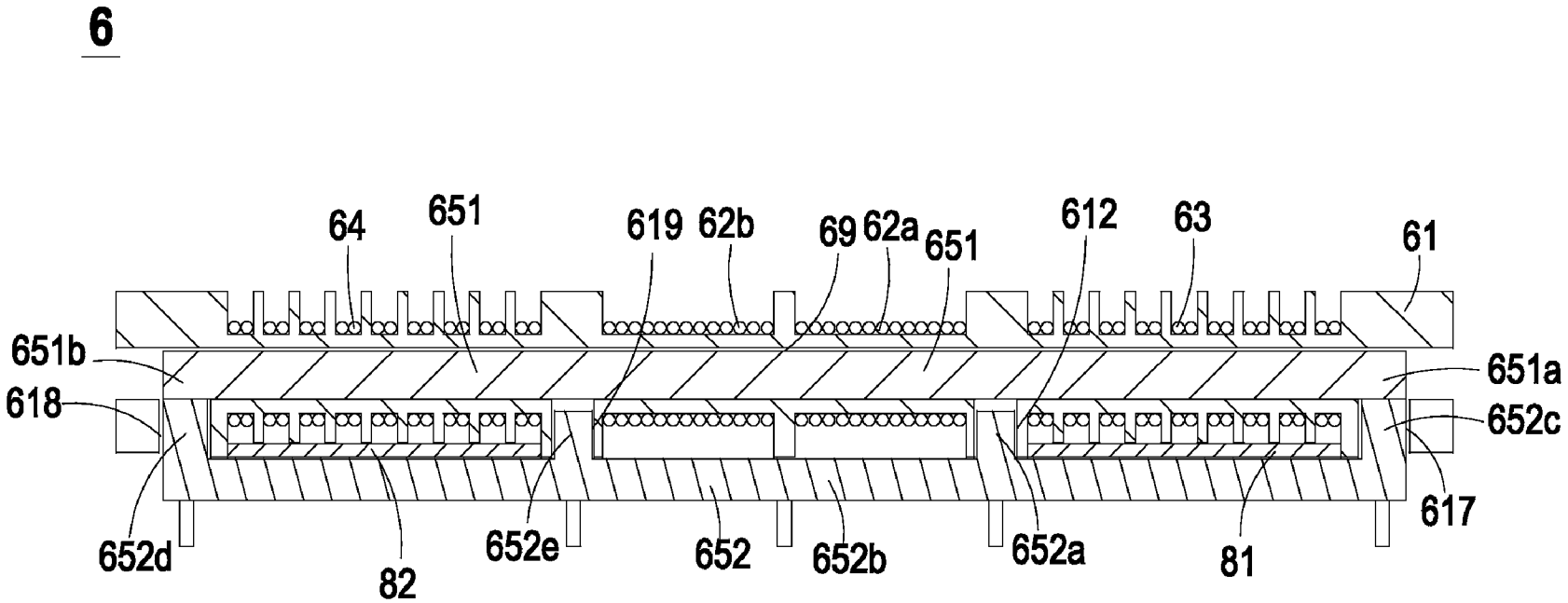

FIGS. 10A and 10B are respectively schematic assembled and cross-sectional views illustrating a combination of the transformer of FIG. 7 and two insulating covers. As shown in FIGS. 10A and 10B, the transformer 6 includes two insulating covers 81 and 82 for partially sheltering the first secondary winding part 87 and/or the second secondary winding part 88. After the first primary winding coil 62*a*, the second primary winding coil 62*b*, the first secondary winding coil 63 and the second secondary winding coil 64 are wound around the bobbin assembly 61, the first insulating cover 81 is sheathed around the first secondary winding part 67. In some embodiments, at least one rib 81*a* is formed on the inner surface of the first insulating cover 81. When the rib 81*a* is engaged with a corresponding winding section 672, the first insulating cover 81 is combined with the bobbin assembly 61 so as to partially shield the first secondary winding part 67 and the first secondary winding coil 63. Similarly, after the first primary winding coil 62*a*, the second primary winding coil 62*b*, the first secondary winding coil 63 and the second secondary winding coil 64 are wound around the bobbin assembly 61, the second insulating cover 82 is sheathed around the second secondary winding part 88. In some embodiments, at least one rib 82*a* is formed on the inner surface of the second insulating cover 82. When the rib 82*a* is engaged with a corresponding winding section 682, the second insulating cover 82 is combined with the bobbin assembly 61 so as to partially shield the second secondary winding part 68 and the second secondary winding coil 64.

From the above embodiment, the extension post of the second magnetic part is inserted into the opening of the bobbin assembly, arranged between the primary winding coil and the secondary winding coil, and separated from the first magnetic part by a gap, so that a branch magnetic circuit is defined by the extension post. The branch magnetic circuit could increase or adjust the leakage inductance of the transformer in order to be applied to various resonant circuits. Moreover, since the second magnetic part is arranged between the bottom surface of the bobbin assembly and the circuit board, the electromagnetic interference generated by the transformer has reduced influence on neighboring electronic components or circuitry of the circuit board.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer having leakage inductance, said transformer comprising:

a bobbin assembly comprising a primary winding part, a first secondary winding part, a second secondary winding part, a channel and a plurality of pins, wherein said pins are extended from a bottom surface of said bobbin assembly, and a first opening and a first slot are integrally formed on said bottom surface of said bobbin assembly and extended toward said channel in a first direction to communicate with said channel;

a primary winding coil wound around said primary winding part;

a first secondary winding coil wound around said first secondary winding part;

a second secondary winding coil wound around said second secondary winding part; and a magnetic core assembly partially embedded into said channel of said bobbin assembly, and comprising a first magnetic part and a second magnetic part, wherein said second magnetic part includes a first extension post and a first lateral post, said first extension post is inserted into said first opening of said bobbin assembly in said first direction, and said first lateral post is inserted into said first slot of said bobbin assembly in said first direction, and wherein said bobbin assembly is mounted on a circuit board such that said second magnetic part is arranged between said bottom surface of said bobbin assembly and said circuit board.

2. The transformer according to claim 1 wherein said primary winding part, said first secondary winding part and said second secondary winding part of said bobbin assembly are made of insulating material and integrally formed into a one-piece structure.

3. The transformer according to claim 1 wherein said primary winding part is arranged at a middle section of said bobbin assembly and includes at least one first partition plate, wherein multiple first winding sections are defined by said at least one partition plate.

4. The transformer according to claim 3 wherein said first partition plate has at least one notch.

5. The transformer according to claim 1 wherein said first secondary winding part and said second secondary winding part are disposed at two opposite sides of said bobbin assembly.

6. The transformer according to claim 1 wherein said first secondary winding part includes at least one second partition plate, said second secondary winding part includes at least one third partition plate, multiple second winding sections are defined by said at least one second partition plate, multiple third winding sections are defined by said at least one third partition plate, and each of said second partition plate and said third partition plate has at least one notch.

7. The transformer according to claim 1 wherein said bobbin assembly further includes a first separation plate and a second separation plate, said primary winding part is separated from said first secondary winding part by said first separation plate, and said primary winding part is separated from said second secondary winding part by said second separation plate.

8. The transformer according to claim 7 wherein said first opening is extended from said bottom surface of said bobbin assembly to an inner portion of said first separation plate and communicates with said channel.

9. The transformer according to claim 8 wherein said bobbin assembly further includes a second opening, which is extended from said bottom surface of said bobbin assembly to an inner portion of said second separation plate and communicates with said channel.

10. The transformer according to claim 9 wherein said first secondary winding part and said second secondary winding part have a first side plate and a second side plate, respectively.

11. The transformer according to claim 10 wherein said bobbin assembly further includes a second slot, said first slot is extended from said bottom surface of said bobbin assembly to an inner portion of said first side plate and communicates with a first end of said channel, and said second slot is extended from said bottom surface of said bobbin assembly to an inner portion of said second side plate and communicates with a second end of said channel.

12. The transformer according to claim 11 wherein said second magnetic part of said magnetic core assembly includes:

a slab portion;

said first lateral post and a second lateral post perpendicularly protruded from a first end and a second end of said slab portion, respectively;

said first extension post and a second extension post arranged between said first lateral post and said second lateral post and, and perpendicularly protruded from said slab portion.

13. The transformer according to claim 12 wherein said first extension post is spaced from said first magnetic part by a gap, and said second extension post is inserted into said second opening of said bobbin assembly and spaced from said first magnetic part by a gap.

14. The transformer according to claim 13 wherein said first lateral post is contacted with a first end of said first magnetic part, and said second lateral post is inserted into said second slot of said bobbin assembly and contacted with a second end of said first magnetic part.

15. The transformer according to claim 14 wherein a cross-section area of each of said first lateral post and said second lateral post is greater than a cross-section area of each of said first extension post and said second extension post.

16. The transformer according to claim 10 wherein each of said first separation plate, said second separation plate, said first side plate and said second side plate includes one or more bobbin bases, each bobbin base includes one or more pins, and each pin includes a first connecting part and a second connecting part.

17. The transformer according to claim 1 wherein said first magnetic part of said magnetic core assembly is a slab-type core magnetic part accommodated within said channel.

18. The transformer according to claim 1 further comprising:

a first insulating cover sheathed around said first secondary winding part of said bobbin assembly and arranged between said first secondary winding coil and said second magnetic part for partially sheltering said first secondary winding part and said first secondary winding coil; and a second insulating cover sheathed around said second secondary winding part of said bobbin assembly and arranged between said second secondary winding coil and said second magnetic part for partially sheltering said second secondary winding part and said second secondary winding coil.

19. A transformer having leakage inductance, said transformer comprising:

a bobbin assembly comprising a first primary winding part, a second primary winding part, a first secondary winding part, a second secondary winding part, a channel and a plurality of pins, wherein said pins are extended from a bottom surface of said bobbin assembly, and a first opening and a first slot are integrally formed on said bottom surface of said bobbin assembly and extended toward said channel in a first direction to communicate with said channel;

a first primary winding coil wound around said first primary winding part;

a second primary winding coil wound around said second primary winding part;

a first secondary winding coil wound around said first secondary winding part;

a second secondary winding coil wound around said second secondary winding part; and a magnetic core assembly partially embedded into said channel of said bobbin assembly, and comprising a first magnetic part and a second magnetic part, wherein said second magnetic part includes a first extension post and a first lateral post, said first extension post is inserted into said first opening of said bobbin assembly in said first direction, and said first lateral post is inserted into said first slot of said bobbin assembly in said first direction, and wherein said bobbin assembly is mounted on a circuit board such that said second magnetic part is arranged between said bottom surface of said bobbin assembly and said circuit board.

* * * * *